US005896719A

United States Patent [19]

Thornton

[11] Patent Number: 5,896,719

[45] Date of Patent: Apr. 27, 1999

[54] ROOF SAFETY ANCHOR

[76] Inventor: Stacy Thornton, 504 N. 4th Ave., Tumwater, Wash. 98512

[21] Appl. No.: 08/707,707

[22] Filed: Sep. 4, 1996

Related U.S. Application Data

[ 60] Provisional application No. 60/003,193, Sep. 5, 1995.

[51] Int. Cl.[6] ..... A47G 29/02

[52] U.S. Cl. ..... 52/698; 52/27; 52/37; 52/712; 52/715; 52/749.12; 52/745.21; 182/45; 248/220.1; 248/499; 248/237

[58] Field of Search ..... 182/3, 45; 52/27, 52/37, 57, 698, 712, 715, 749.12, 745.21, DIG. 1; 248/220.1, 499, 536, 237

[56] References Cited

U.S. PATENT DOCUMENTS

| | | | |
|---|---|---|---|
| 591,772 | 10/1897 | Metter | 248/237 |
| 1,470,489 | 10/1923 | Schuh . | |
| 2,474,920 | 7/1949 | Stearns . | |
| 2,575,254 | 11/1951 | Blaugrund | 248/237 X |
| 2,703,688 | 3/1955 | Shutter | 248/237 X |
| 3,184,800 | 5/1965 | Nelson . | |
| 3,237,717 | 3/1966 | Jackson . | |
| 3,292,734 | 12/1966 | Swanberg . | |
| 3,359,701 | 12/1967 | Schneller | 52/712 |
| 3,481,635 | 12/1969 | Tracy . | |
| 3,606,226 | 9/1971 | Bell, Sr. . | |
| 4,089,141 | 5/1978 | Heroux | 52/DIG. 1 X |
| 4,249,713 | 2/1981 | Glynn et al. | 52/37 X |
| 4,570,403 | 2/1986 | Dannemiller | 52/712 X |
| 5,011,106 | 4/1991 | Cody . | |
| 5,054,576 | 10/1991 | Glynn . | |
| 5,143,171 | 9/1992 | Glynn et al. | 52/27 X |
| 5,248,021 | 9/1993 | Nichols | 182/3 |
| 5,257,483 | 11/1993 | Netek | 52/712 X |
| 5,287,944 | 2/1994 | Woodyard | 182/3 |
| 5,311,708 | 5/1994 | Frye | 52/90.1 |
| 5,361,558 | 11/1994 | Thornton et al. . | |
| 5,561,949 | 10/1996 | Knoth | 52/92.2 |

FOREIGN PATENT DOCUMENTS

| | | | |
|---|---|---|---|
| 2384918 | 11/1978 | France | 182/45 |
| 2440508 | 7/1980 | France | 52/712 |
| 28 47 275 | 5/1980 | Germany . | |
| 3121019 | 12/1982 | Germany | 52/37 |

*Primary Examiner*—Christopher Kent
*Assistant Examiner*—Laura A. Callo
*Attorney, Agent, or Firm*—Delbert J. Barnard

[57] ABSTRACT

A roof safety anchor (10) having an elongated body (22) including a right edge (23), a left edge (24), a fixed end (25) and a rigid free end (26) that defines an aperture (28). The body (22) is of a size and shape to conform to a roof (R, R1, R2, R3, R4) of a building, wherein the roof has a layer of roof cladding (16), layered over a layer roof sheathing (12), which is layered over spaced apart structural beams (14). The fixed end (25) is fixably connected to the roof sheathing (12), and underneath the roof cladding (16). Preferably, the fixed end is fixedly connected to the roof sheathing through a plurality of lag bolts. The free end (26) protrudes outwardly from the roof, over the roof cladding (16). In use, an object, such as a safety line, is tied to the free end (26) through the aperture (28) in order to anchor the object the roof (R, R1–R4). The anchor (10) also includes a plurality of bending lines, wherein each line connects the right edge (23) to the left edge (24) and is positioned between the free end (26) and the fixed end (25). Each bending line is bent to form an angle to conform to the roof. Methods of securing anchor (10) are provided for various roof types, specifically, a peaked roof (R1), a roof-to-wall (R2), a one ridged peaked roof (R3), and a large roof requiring a midspan anchor (R4). Anchor (10) may also include a plurality of security tabs (74, 76) that are bent to conform to a structural beam, either below the roof, such as a structural wall, or on the roof itself underneath the roof sheathing.

21 Claims, 9 Drawing Sheets

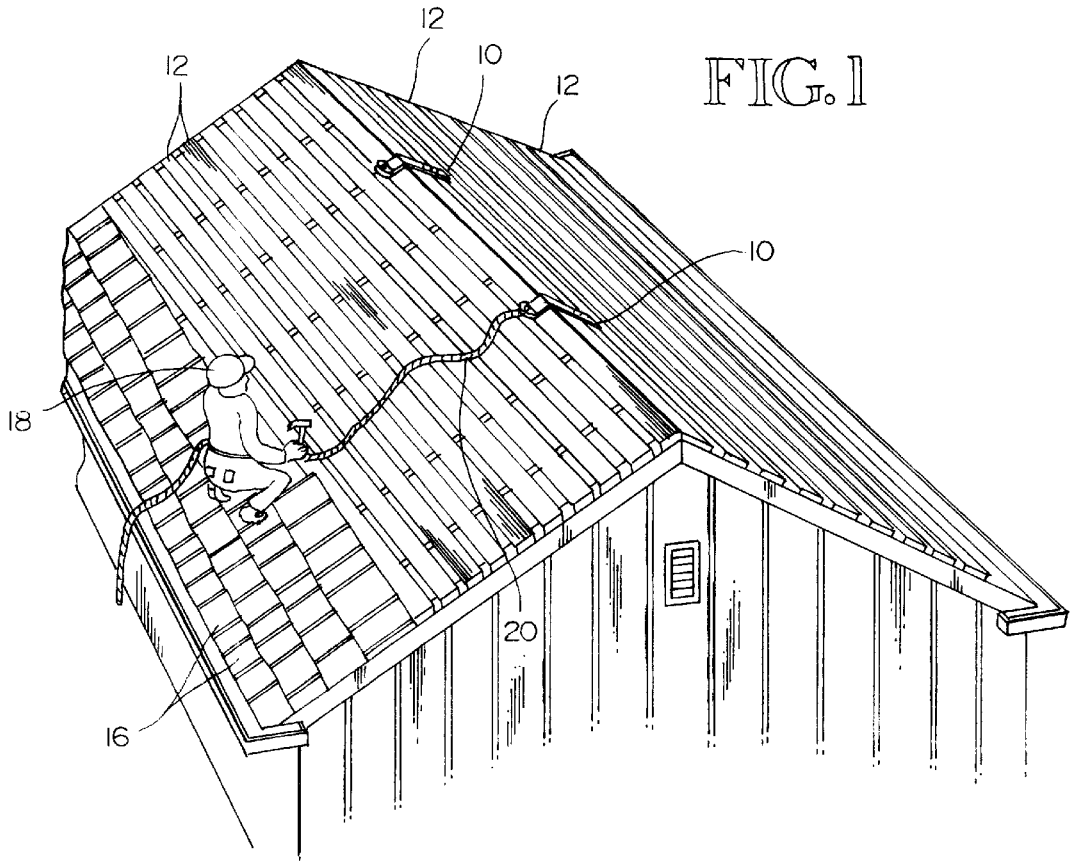
FIG. 1
FIG. 2
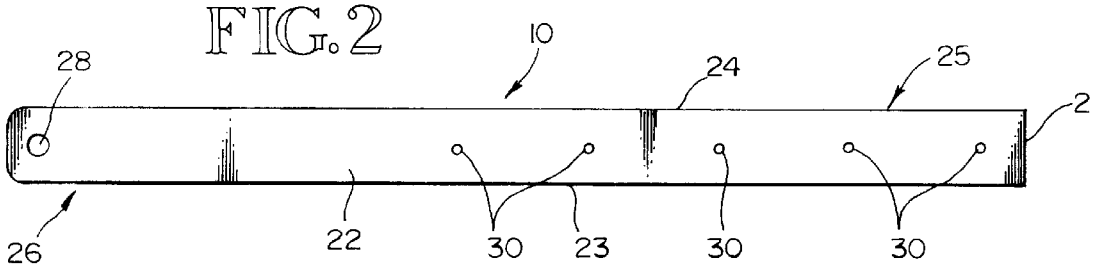

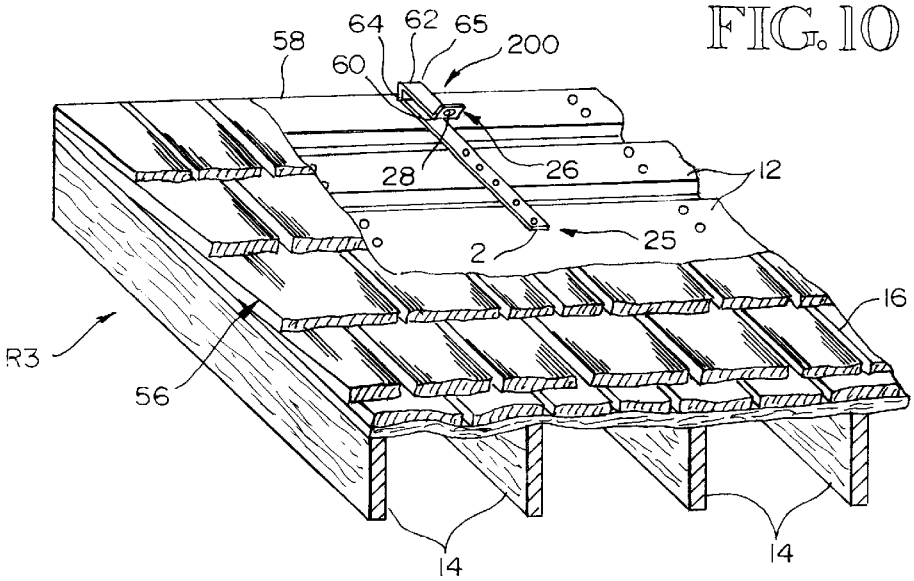
FIG. 10
FIG. 11
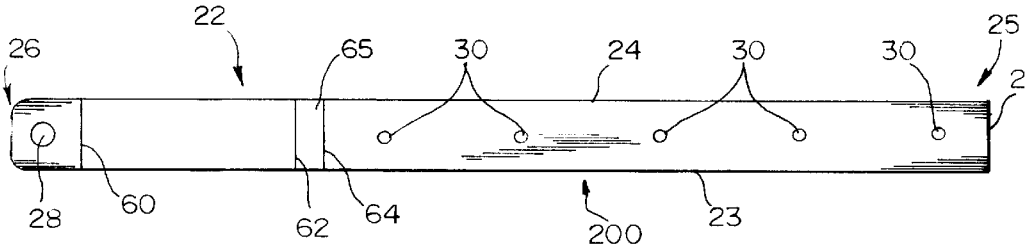
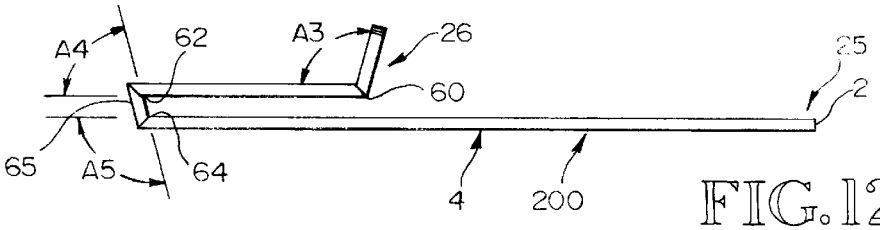
FIG. 12
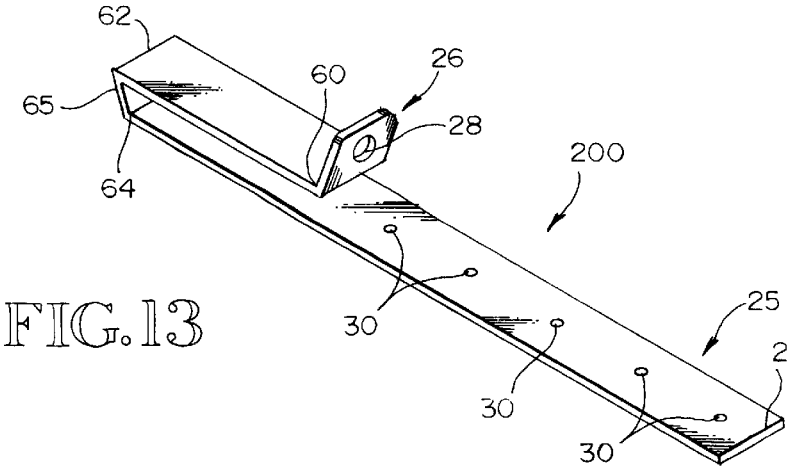
FIG. 13

FIG. 22
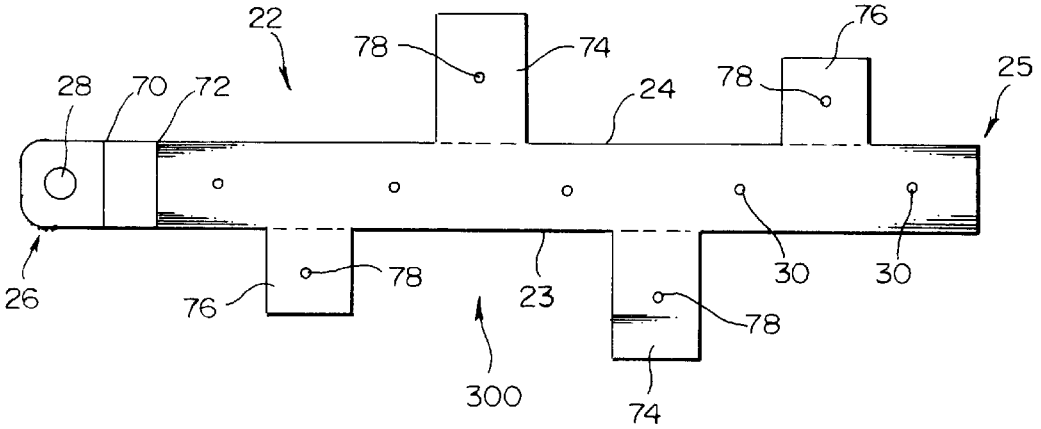
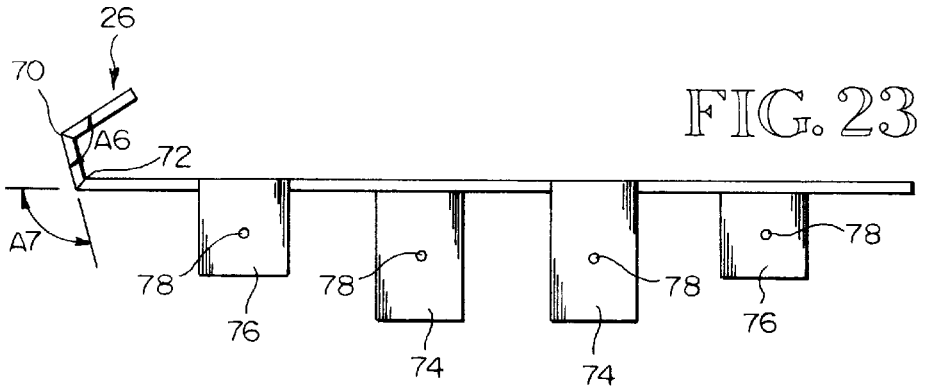
FIG. 23
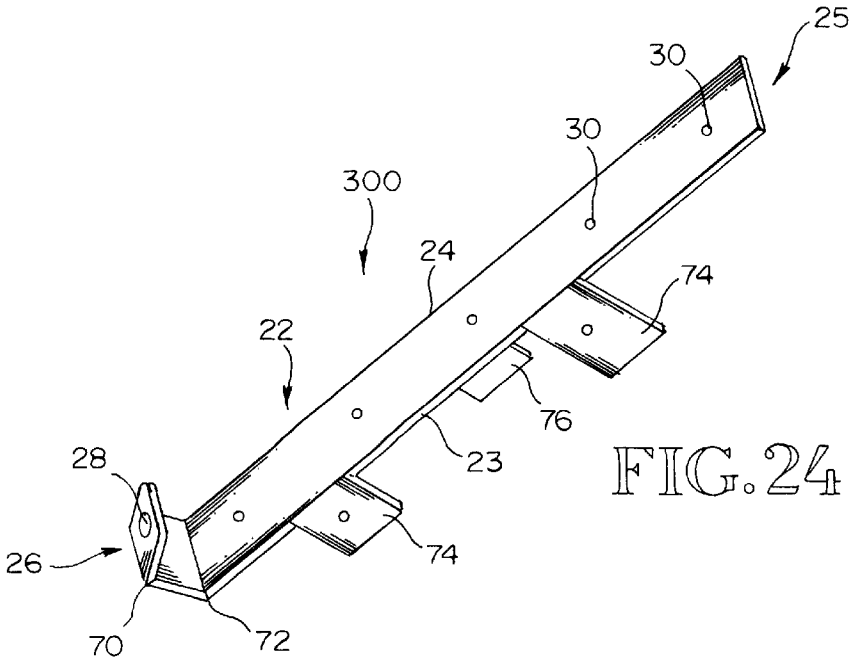
FIG. 24

ROOF SAFETY ANCHOR

RELATED APPLICATION

This application is the conversion of Provisional Patent application Ser. No. 60/003,193 filed Sep. 5, 1995 and entitled "ROOF SAFETY ANCHOR" under 35 U.S.C.§ 111(b) to a regular U.S. patent application under 35 U.S.C. §111(a).

TECHNICAL FIELD

The present invention relates to an anchor for a roof of a building. More particular, the invention relates to a permanent safety anchor mounted to a roof in which a person may tie a safety line in order to safeguard against a hazardous fall when the person is working on the roof.

BACKGROUND OF THE INVENTION

A roof of one's home is inherently a dangerous place. A fall off a roof can be extremely hazardous, possibly even fatal. Contractors who provide roof related services, such as roofing, chimney repairs, pressure washing, and vent repair, are aware of the inherent dangers. In addition, home owners occasionally find themselves atop their roofs to inspect for repairs, clean out gutters, etc. The danger to the homeowner may be even greater than to the contractor, as the homeowner is not used to regularly working with the inherent hazard.

Many states, such as Washington, require workers to tie off when working on a roof by an anchored line that can carry up to 5000 pounds of load. Often a worker on a roof utilizes a safety line, which has an anchored end, while the other end is attached to the worker. My U.S. Pat. No. 5,361,558, along with co-inventor Jon McCown, granted Nov. 8, 1994, entitled "Roof Mountable Safety Line Anchor" addressed an anchor for a safety line for a peaked roof application. However, my prior invention does not address various roof types. It is an object of the present invention to be able to accommodate various roof types with one basic anchor body type.

SUMMARY OF THE INVENTION

The present invention provides an apparatus and method for providing a roof safety anchor for a roof of a building. The roof includes a layer of roof cladding, layered over a layer of roof sheathing, which is layered over spaced apart structural beams. The roof safety anchor comprises an elongated body having a right edge, a left edge, a fixed end, and a rigid free end that defines an aperture. The body is of a size and shape to conform to the roof. A plurality of bending lines connect the right edge to the left edge and are positioned between the free end and the fixed end. Each bending line is bent to form an angle to allow the body to conform to the roof. The fixed end is fixedly connected to the roof sheathing, underneath the roof cladding. The free end protrudes outwardly from the roof over the roof cladding. In use, an object is tied to the roof through the aperture in order to anchor the object to the roof.

According to one aspect of the invention, the anchor has two bending lines bent to form a first angle situated between the free end and the second bending line in the second angle situated between the fixed end and the first bending line. In preferred form, the angle is in the range of 100 degrees to 120 degrees, and the second angle is in the range of 145 degrees to 165 degrees. In another form, the first angle is in a range of 100 degrees to 120 degrees and the second angle is in the range of 95 to 110 degrees.

According to another aspect of the invention, the anchor has three bending lines to form a first angle situated between the free end and the second bending line, a second angle situated between the first and third bending lines, and a third angle situated between the fixed end and the second bending line. Preferably, the first angle is in the range of 100 to 120 degrees, the second angle is in the range of 70 to 90 degrees, and the third angle is in the range of 95 to 110 degrees.

In preferred form, the fixed end is fixedly connected to the roof sheathing by a plurality of light bolts.

According to another aspect of the invention, the anchor further comprises at least one security tab projecting outwardly from the right edge of the body and at least one security tab projecting outwardly from the left edge of the body. Each tab is bent to form a generally perpendicular angle with the anchor body. In use, the anchor is attached directly to a structural beam with the security tabs receiving the beam. In preferred form, at least one right tab is of a different size than the at least one left tab. Also, each tab is laterally offset, longitudinally of the body and transversely of the other at least one tab.

The invention also includes a method of securing a safety line having various roof forms. The first roof type is a peaked roof with a first pitch and a second pitch. The roof has a layer of sheathing layered over a plurality of spaced apart structural beams. The method comprises providing a roof safety anchor having an elongated body with a right edge, a left edge, a free end that defines an aperture, a fixed end and two bending lines connecting the right edge to the left edge. The two bending lines are positioned between the free end and the fixed end. The roof anchor is then bent to conform to the peak of the roof along its first and second bending lines to form a first angle between the free end and the second bending line, and the second angle between the fixed end and the first bending line. The second angle is formed to fit atop the peak of the roof and the first angle is formed to project the free end outward. The anchor is then mounted over the roof sheathing such that the second angle is mounted over the peak. The fixed end is fixedly connected to the roof sheathing on one pitch. The free end projects outwardly from the roof sheathing on the other pitch. Roof cladding is then layered over the roof sheathing such that the cladding is mounted over the fixed end of the anchor and underneath the free end of the anchor. The ridge cap is then applied over the peak of the roof. A worker then ties one end of a safety line to the free end through the aperture to secure the safety line to the roof.

Another method includes mounting a roof safety anchor having two bending lines to conform to a building having a lower roof with a peak and an upper roof, wherein the lower roof and upper roof are separated by a vertical wall. The lower roof and wall each have sheathing layered over spaced apart structural beams. The wall and the lower roof join at the peak of the lower roof to form a roof angle. The anchor is bent along two bending lines to form two angles. The second angle conforms to the roof angle. The fixed end of the anchor is fixedly connected to the wall and the free end projects outwardly from the lower roof.

Another method includes mounting a safety line to a building having a one sided peaked roof with sheathing layered over spaced apart structural beams. The anchors is bent along three bending lines, wherein a first angle is bent to allow the free end to project outwardly from the roof and the second and third angle to allow the body to angle back over the fixed end.

Another method includes mounting a roof safety anchor to a building having at least one sided large peaked roof to provide a midspan anchor generally centrally of the pitch of the roof. Here, the anchor has two bending lines to form two angles, wherein the first and second angles allow the free end to project outwardly from the roof.

According to another aspect, a method includes mounting a roof safety anchor to a building having a roof supported by a plurality of exterior walls. The walls and roof have sheathing layered over a plurality of spaced apart structural beams. Each beam has a width and a length. The roof safety anchor includes a plurality of bending lines and at least one security tab mounted to each edge of its body. The security tabs are bent to receive the width of one of the structural beams. The anchor body is bent at its bending lines to form angles to receive the length of the same beam. Thus, the free end projects outwardly from the beam.

These and other advantages, objects, features will become apparent from the following best mode description, the accompanying drawing, and the claims, which are all incorporated herein as part of the disclosure of the invention.

BRIEF DESCRIPTION OF THE DRAWING

Like reference numerals are used to indicate like parts throughout the various FIGS. of the drawing, wherein:

FIG. 1 is a pictorial view depicting a worker with a safety line attached to an anchor fixedly attached to a roof;

FIG. 2 is a top plan view of an elongated anchor body prior to bending;

FIG. 10 is a pictorial view of a one-ridged roof with a different embodiment of the anchor of FIG. 3;

FIG. 11 is a plan view of the anchor of FIG. 10 prior to bending;

FIG. 12 is a side view of the anchor of FIG. 10;

FIG. 13 is a pictorial view of the anchor of FIG. 10;

FIG. 22 is a view like FIG. 15, but with the security tabs projecting from the right and left edges of the anchor body;

FIG. 23 is a side view of the anchor of FIG. 22;

FIG. 24 is a pictorial view of the anchor of FIGS. 22 and 23 showing the security tabs in their bent form.

BEST MODE FOR CARRYING OUT THE INVENTION

Figure 3:
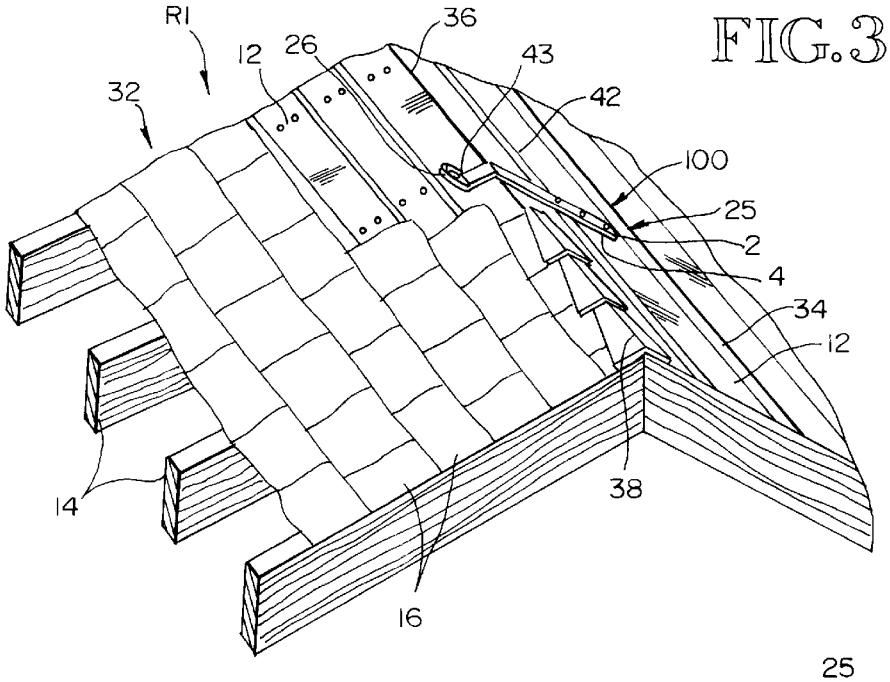
FIG. 3 is a pictorial view of a peaked roof with roof sheathing and one embodiment of the bended anchor in cutaway.

The present invention is an improvement of my aforementioned U.S. Pat. No. 5,361,558. This patent should be studied for the purpose of putting the present invention into proper perspective. The entirety of U.S. Pat. No. 5,361,558 is incorporated herein by specific reference. In my patent mentioned above, a safety line anchor is installed on a peaked roof to provide a safety line connection for a worker working on, or near, the roof with an anchor fixed to it. The present invention discloses various structural variations of a safety line roof anchor for various roof types, not just peaked roofs.

Referring to FIG. 1, all variations of the invention include a safety line anchor 10 that is fixedly attached to a roof R having roof sheathing 12 mounted to a plurality of spaced apart structural beams (rafters) 14 (shown in FIGS. 3, 7, 8, 10, and 25), and roof cladding 16, but ultimately is mounted over the roof sheathing 12. A worker 18 uses a safety line 20 that attaches to the fixed anchor 10.

Common to all variations of anchor 10 is an elongated body 22 having a right edge 23, a left edge 24, a fixed end 25, and a free end 26 as shown in FIG. 2. Body 22 includes a back 4 (best shown in FIG. 5). Fixed end 25 includes a fixed end edge 2. A safety line connection point 28 is an aperture defined by the free end 26. Each anchor has a connection means 30, which allows the anchor to be fixedly connected to the roof R. Once the anchor is fixedly connected to roof R, the worker 18 attaches one end of the safety line 20 to a harness or belt located on the worker and attaches the other end of the safety line 20 to the connection point 28 of the free end 26. This connection secures the worker to the roof through the safety line, should the worker fall, lose footing, or such other accident/incident, in order to keep the worker from falling off the roof and severely injuring himself.

The anchor may be made of many different metals or man-made materials. However, in preferred form, the anchor is made from 12 gauge stainless steel, which provides superior strength and resistance to rust.

The various embodiments of the anchors are dictated by particular roof styles. Referring to FIG. 3, the more traditional peaked roof R1 having a first pitch 32, a second pitch 34, a peak 36, and a ridge cap 38, requires an anchor 100 having a first bending line 40 and a second bending line 42.

Figure 4:
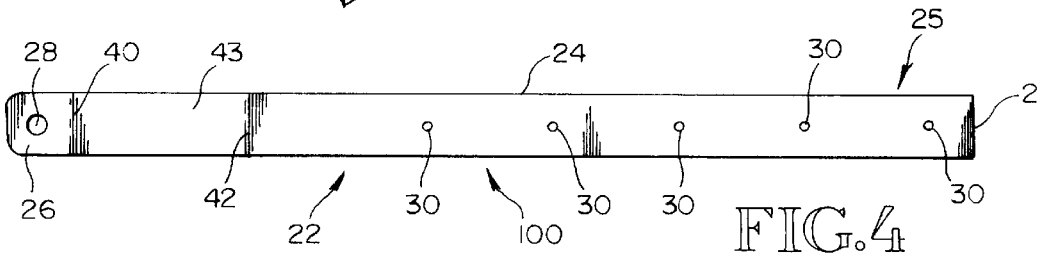
FIG. 4 is a plan view of the anchor of FIG. 3 prior to bending.

Referring to FIG. 4, the two bending lines connect the right edge to the left edge and are positioned between the free end and the fixed end.

Figure 5:
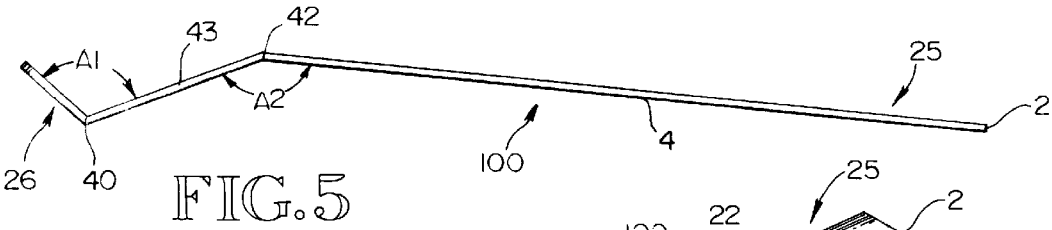
FIG. 5 is a side view of the anchor of FIG. 3.

The first bending line 40 of anchor 100 is positioned adjacent to the free end 26. The second bending line 42 is positioned adjacent the first bending line 40 and is oppositely situated from free end 26. When installed, anchor 100 is bent to form two separate angles as shown in FIG. 5. The first angle A1 and the second angle A2 may be bent to various angles to conform to the peaked roof R1. However, in preferred form, angle A1 for roof R1 is about 110° and the angle A2 is about 154°.

Figure 6:
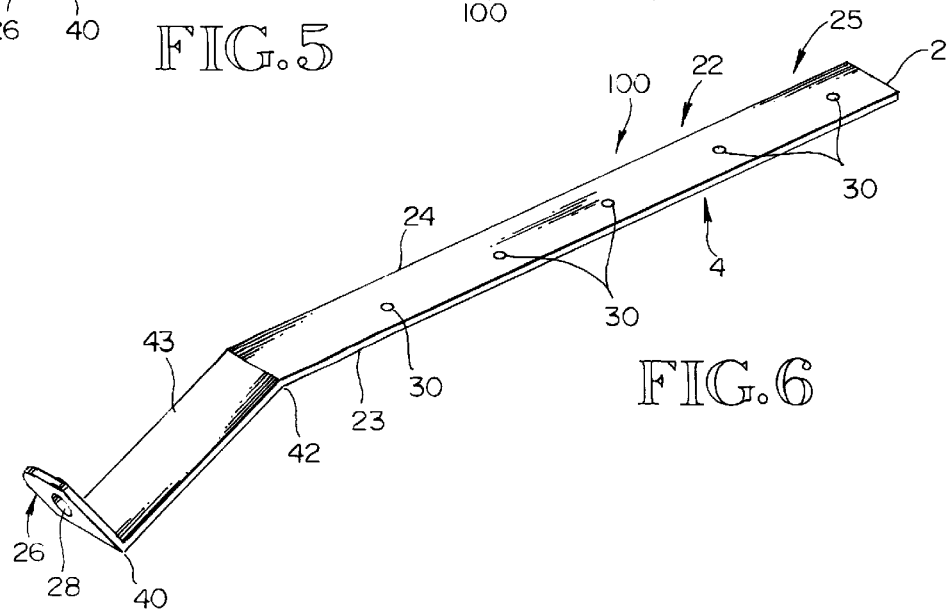
FIG. 6 is a pictorial view of the anchor of FIG. 3.

A pictorial view of anchor 100 for roof R1 is shown in FIG. 6. After bending, the free end 26 projects outwardly from roof R1 to allow the safety line 20 to connect through the aperture 28 of free end 26 with ease.

Figure 7:
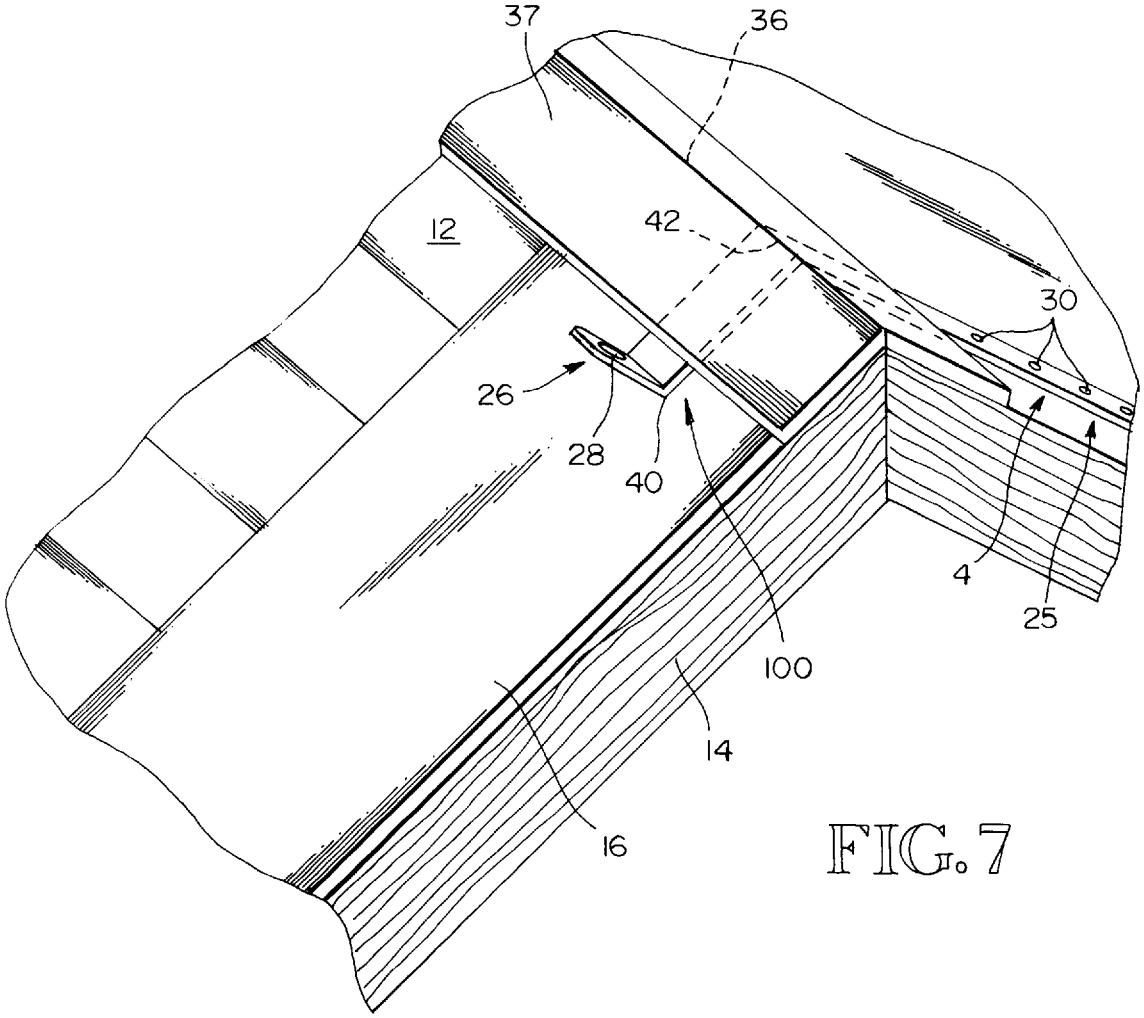
FIG. 7 is a pictorial view of the anchor of FIG. 3 mounted atop roof cladding and beneath a ridge cap.

Referring to FIG. 7 and also to FIG. 3, in construction, anchor 100 is positioned on top of the roof sheathing 12. The anchor 100 is then connected to roof R1 through the connecting means 30. In preferred form, anchor 100 is permanently attached through the roof sheathing 12 to a rafter with a plurality of lag screws. Roof cladding 16 is arranged and secured over the roof sheathing 12 and the fixed end 25 of anchor 100. Roof cladding 16 is secured to roof cladding underneath the free end 26. The ridge cap 38 is placed and fixed to the top of roof R1 at the peak 36. The free end 26 projects forth from the roof cladding 16, and is intended to be a permanent extended anchor for a safety line to connect to for future roof repairs/maintenance. In this manner, the anchor 100 does not pierce the roof cladding; hence, neither flashing nor pitch are required.

Figure 8:
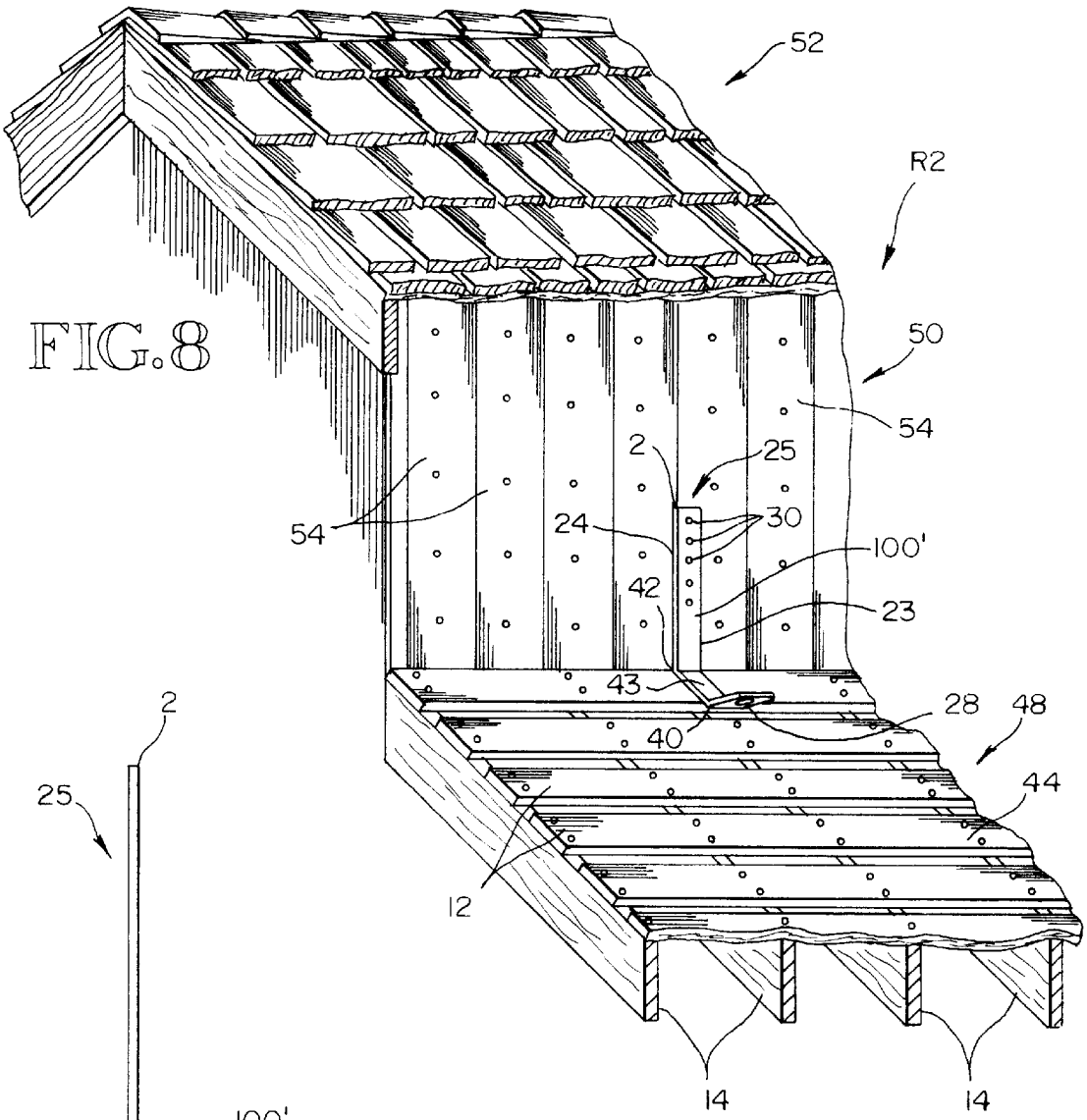
FIG. 8 is a pictorial view of a roof-to-wall application with a different embodiment of the anchor of FIG. 3.

Anchor 100 may be used to form anchor 100' for another roof application as shown by roof-to-wall R2 in FIG. 8. Roof-to-wall R2 includes a lower roof pitch 44 with a peak 46, (of which both form a lower roof 48), a wall 50 extending upwardly from peak 46, and an upper roof 52. The wall 50 includes a layer of wall sheathing 54, which is mounted onto stud walls (not shown). A layer of wall cladding, such as shingles or bevel siding, (also not shown) may be added over the wall sheathing 54.

Anchor 100 is bent in a different configuration to form anchor 100' by having angle A2 bent in the reverse direction at approximately the same angle at bending line 42. In its new form, anchor 100' can be mounted in a roof-to-wall application. The fixed end 25 of anchor 100' attaches to wall sheathing 54 via the connection means 30. Wall cladding may be affixed to the wall 50, over the wall sheathing 54, and over the fixed end 25 of anchor 100'. Roof cladding 16 may also be affixed to roof 48 over roof sheathing 12 covering an intermediate portion 43 between the two bending lines 40, 42. The free end 26 of anchor 100' projects outwardly from the roof 48 in order to attach safety line 20 to aperture 28.

Figure 9:
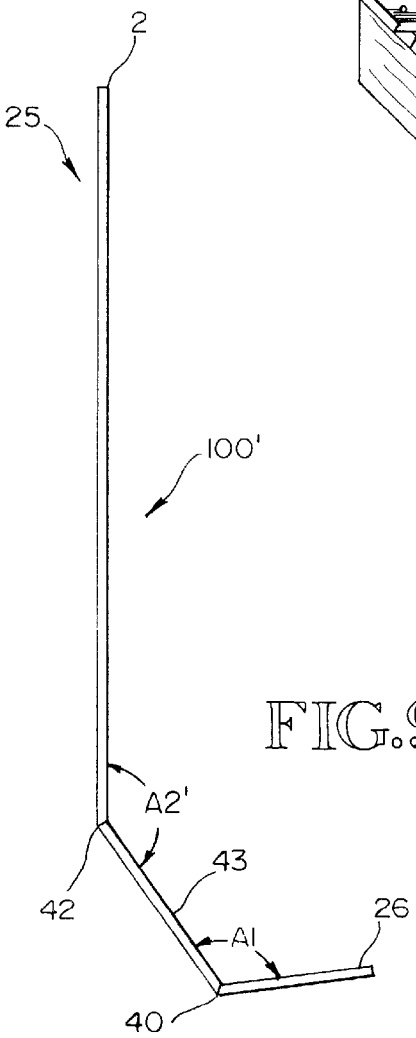
FIG. 9 is a side view of the anchor of FIG. 8.

FIG. 9 depicts a side view of anchor 100' after bending to conform to a roof-to-wall R2 installation.

Referring to FIG. 10, another variation, anchor 200 is used for a one-ridge roof application R3. In this application, roof R3 has one pitch 56 and a peak 58, but does not have a second pitch on the other side of peak 58. Hence, a different anchor is required to provide a secured free end 26 for safety line to attach onto.

Referring to FIG. 11, anchor 200 has three bending lines 60, 62, 64 in order to form three angles A3, A4, A5, once anchor 200 is bent to conform to roof R3. FIGS. 12 and 13 depict anchor 200 in its bent form. In preferred form, angle A3 of is about 110°, angle A4 is about 77°, and angle A5 is about 103°.

Referring back to FIG. 10, the fixed end 25 of anchor 200, s attached to the roof sheathing 12 through the connection means 30. The roof cladding of roof R3 is affixed to the roof sheathing over the fixed end 25 and may continue up to peak 58. The free end 26 and the anchor portion between the first and third bending lines 60 and 64 project over the roof cladding 16. An intermediate portion 65 between the second and third bending lines 62 and 64 projects upwardly and outwardly from the roof line. The anchor portion from the first bending line to the second bending line 60 and 62 projects in a downward position back up and over the fixed end 25. The free end 26 projects outwardly at the first bend line 60.

Figure 14:
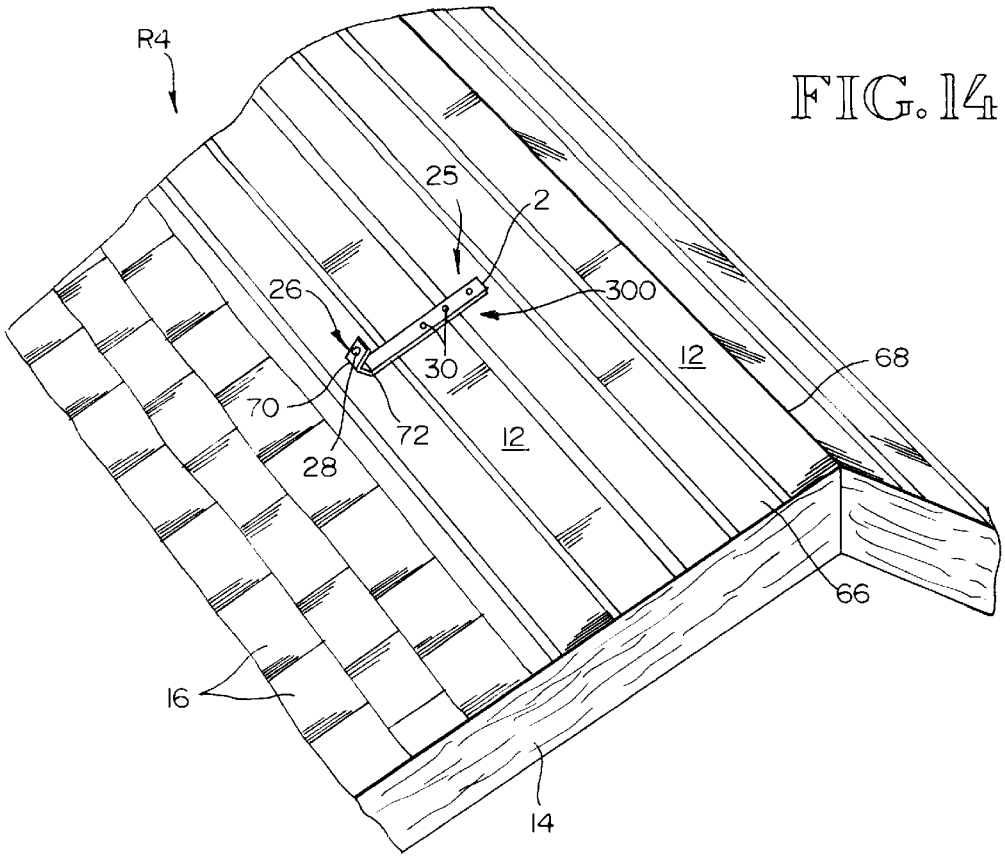
FIG. 14 is a pictorial view of a large roof requiring a midspan anchor, which is a different embodiment of the anchor of FIG. 3.

Another type of anchor application is shown in FIG. 14 where the roof may be so large that a midspan anchor is required by building codes and/or is desired for additional safety of the worker 18. Large roof R4 has a first pitch 66 and a peak 68. A midspan anchor may be used in combination with any of the earlier-described anchors of this application.

Figure 15:
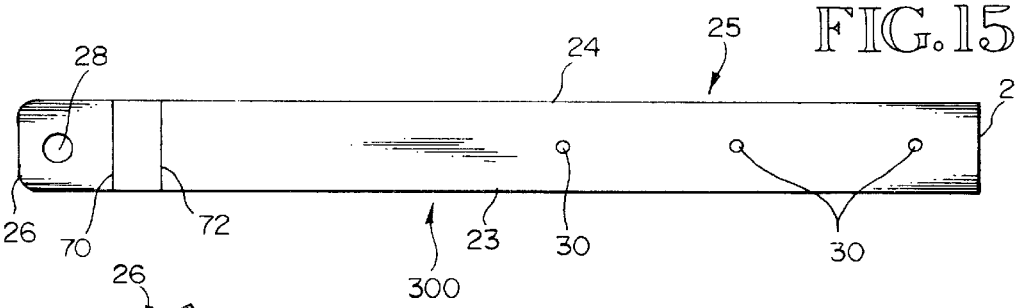
FIG. 15 is the plan view of the anchor of FIG. 14 prior to bending.
Figure 16:
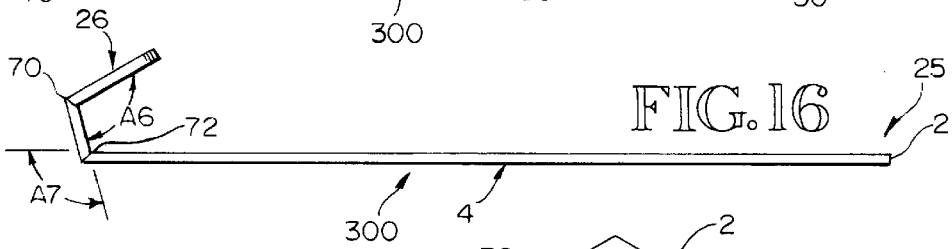
FIG. 16 is a side view of the anchor of FIG. 14.
Figure 17:
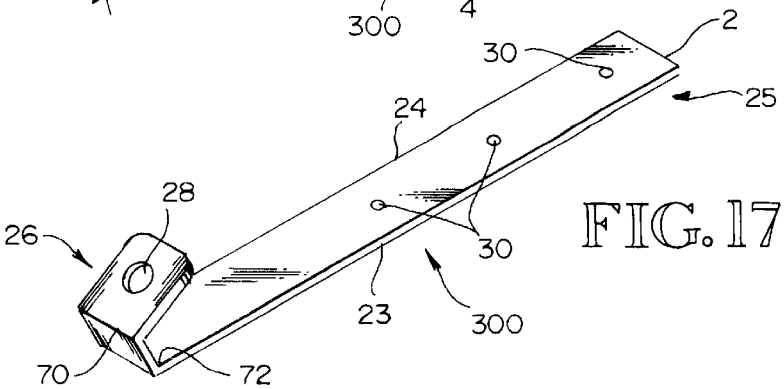
FIG. 17 is a pictorial view of the anchor alone of FIG. 14.

FIG. 15 shows a midspan anchor 300 having two bending lines 70, 72 in its prebent form to conform to roof R4. After anchor 300 is bent to conform to roof R4, as depicted in FIGS. 16 and 17, angle A6 and A7 are formed. In preferred form, angle A6 is about 110° and angle A7 is about 103°.

Referring back to FIG. 14, the fixed end 25 of anchor 300 is secured through the connector means 30 to roof sheathing 12. Roof cladding 16 is attached and secured to the roof sheathing 12 and over the fixed end 25 of anchor 300. The anchor portion between bending line 70 and 72 extends outwardly from the roof cladding 16. The free end 26 projects upwardly and outwardly from roof R4, which provides a secured aperture for safety line 20 to attach onto.

Figure 18:
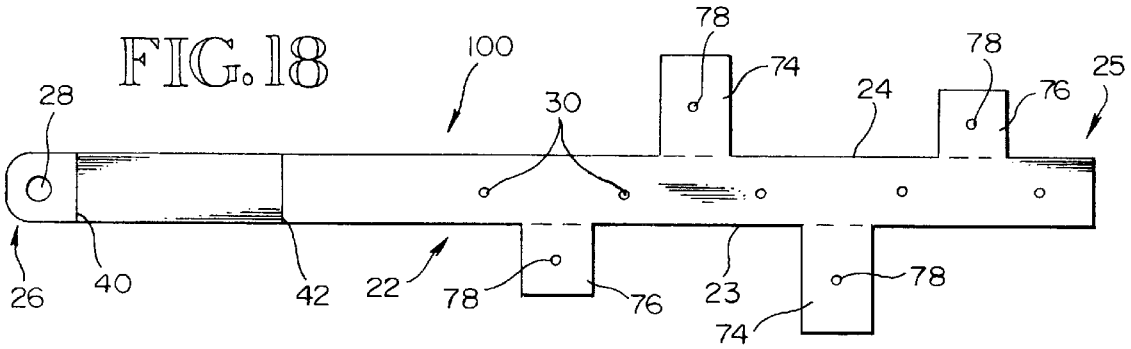
FIG. 18 is a plan view of the anchor as shown in FIG. 4 but with security tabs attached to a right edge and a left edge of the anchor body.
Figure 19:
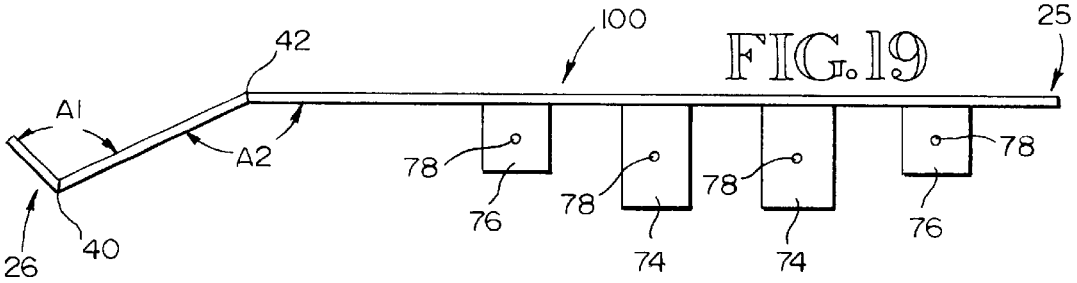
FIG. 19 is a side view of the anchor of FIG. 18.
Figure 20:
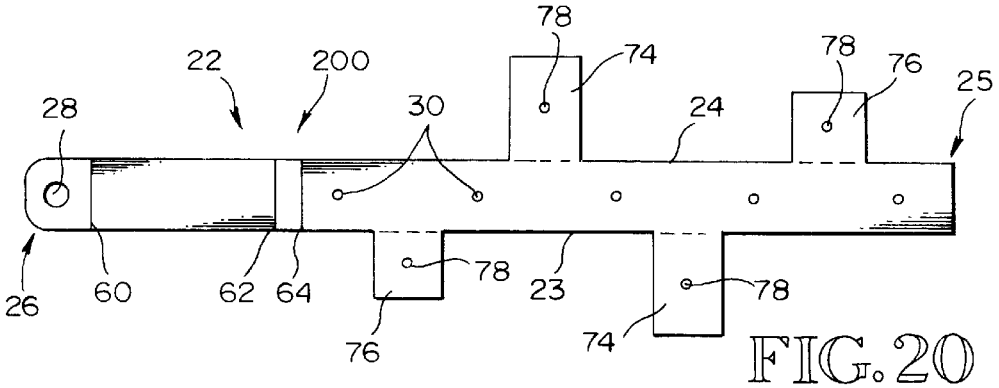
FIG. 20 is a view like FIG. 11 but with the security tabs projecting from the right and left edges of the anchor body.
Figure 21:
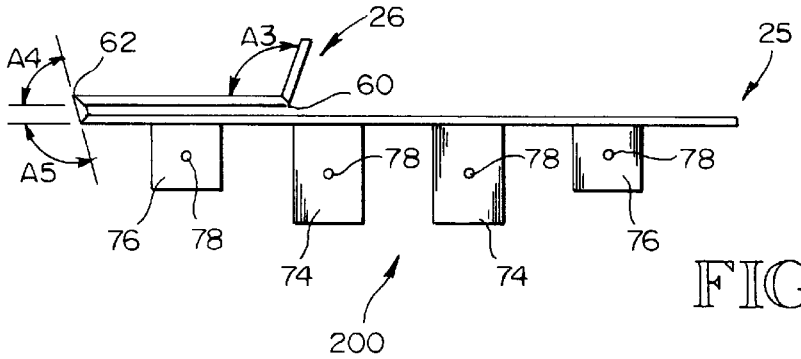
FIG. 21 is a side view of the anchor of FIG. 20.

FIGS. 18–24 depict the various anchors 100, 200, 300 with the addition of security tabs. The tabs may comprise two long security tabs 74 and two short tabs 76. In preferred form, one long tab 74 and one short tab 76 are attached to the right edge of the elongated body 22 of the various anchors. The other large security tab 74 and short security tab 76 is attached at the left edge 24 of the elongated body 22 of the various anchors. FIGS. 18, 20 and 22 depict the top plan view of the addition of the security tabs to anchors 100, 200, and 300, respectively. The security tabs 74, 76 are bent approximately to form a 90° angle to the elongated body or in some angle to conform to a wall beam or roof beam 14. Each security tab has a connection means 78 that secures the security tab to the roof or wall sheathing or beam to provide extra fastening protection. FIGS. 19, 21 and 23 depict the bent anchor with the bent security tabs for anchors 100, 200, and 300 respectively. FIG. 24 is a pictorial view of anchor 300 with the bent security tabs. FIG. 24 is illustrative of all of the anchor variations with the bent security tabs.

Figure 25:
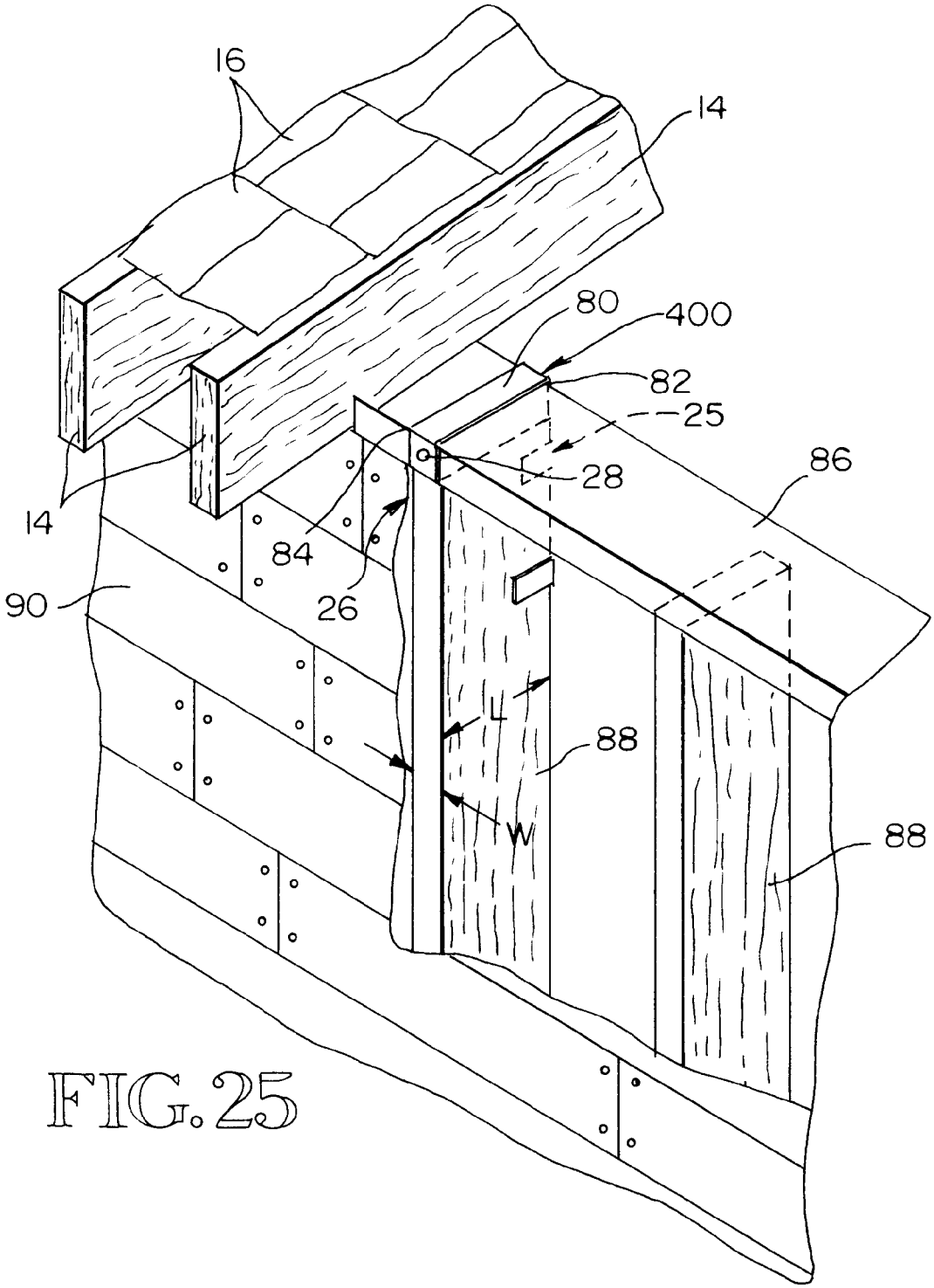
FIG. 25 is a pictorial view of a different embodiment of the anchor of FIG. 3 mounted atop a plate and fixedly connected to a structural beam shown in cutaway.

Referring to FIG. 25, another embodiment of the roof safety anchor, anchor 400, is shown for use in tying off ladders to a side of a house or building. Anchor 400 is bent in such a way that a middle portion 80 is between two bending points 82 and 84. Anchor 400's middle portion 80 spans a plate 86, which is a roughly perpendicular to a plurality of wall beams 88. A roof may exist over the wall and plate 86 as shown in FIG. 25. Roof beams 14 of the roof may be supported by plate 86. The fixed end 25 of anchor 400 is attached to an edge of the wall beam 88. The free end 26 hangs over the plate 86. Wall cladding 90, which is generally mounted over wall sheathing (as shown in FIG. 8), is mounted to the beams 88. The free end 26 of anchor 400 projects out and over the wall cladding 90 such that a safety line may be tied to the aperture 28 of the free end 26 of the anchor 400.

Common to all anchor configurations, the connection means 30 attaches the fixed end 25 of the various anchors to a roof or wall as dictated by the application. In preferred form, a series of apertures are drilled (or stamped or molded) into the fixed end 25. In preferred form, there are at least three apertures for each fixed end 25. Anchors 100, 100' and 200' preferably have five apertures. The fixed end 25 is fixed to the roof or wall by inserting a plurality of lag screws into the apertures of the fixed end and into the roof sheathing, wall sheathing, or beam. There may be one screw secured for each aperture. Nails or other equivalents, although less preferred, may be used to affix the fixed end 25 to the roof or wall. Epoxy or other adhesives may be also be used as a connection means instead of the screws or nails. The connector means are intended to be a permanent connection of the fixed ends of the anchors to the roof or wall depending upon the application, or at least until a worker purposely removes the anchor from the roof.

Referring back to FIGS. 18–23, as to the connection means 78 of the security tabs, each security tab has at least one aperture located generally centrally within each tab. The security tab is permanently affixed to a wood rafter or wooden wall stud through the use of screws inserted into the aperture of the security tabs into the wall or roof stud or rafter. Other forms of connecting the security tabs also include nails or some type of epoxy/adhesive. The benefit of having a large tab and a small tab on each side of the anchor is that the wooden beam is not weakened by the screw or nail in an aperture at the same grain line of the wooden material.

The roof sheathing 12 as depicted in the various figures may be in the form of boards or a sheet of material attached to the beams 14. Preferably, the anchors are attached through the roof sheathing over a beam 14.

Roof cladding 16 is installed over the sheathing 12. The roof cladding 16 may be in the form of a shake or asphalt singles, slate or tile. The roof cladding may, but does not necessarily, include a ridge cap already discussed in FIG. 3. Referring back to FIG. 1, more than one anchor may be installed per roof as shown in this view. Also, the midspan application as shown in FIG. 14 also suggests two anchors: one at the midspan, and one possible at the peak (if there is a peak) or at a wall if there is a wall above the peak line.

The anchors may be stamped, machined, molded or made through other well-known manufacturing processes. A brake press may be used to initially press the bending line, giving the anchors a slightly bent configuration at purchase. The final bending to conform to its specific roof application can be accomplished at the job site.

In preferred form, the various anchors 100, 100', 200, and 300 should be able to bear at least 5,000 pounds of load each, in keeping with various local and state building codes.

Methods of securing a safety line to the various roof types are disclosed above and included in my invention. Other variations in construction or implementation of this invention can be made without substantially departing from the spirit and scope of the invention. For example, the exact order of the method claims need not be followed, rather several steps may be reversed and still be the same claimed invention. The embodiments illustrated and described above are not to be considered limitive, but illustrative only. Therefore, it is my intention that my patent rights not be limited by the particular embodiments illustrated and described, herein, but rather determined by the following claims, interpreted according the the accepted doctrines of claim interpretation including the doctrine of equivalents and reversal of parts.

What is claimed is:

1. A roof safety anchor system, comprising:

a roof of a building having a layer of roof cladding over a layer of roof sheathing, which is layered over spaced-apart structural beams;

a safety anchor including an elongated body having a front, a back, a right edge, a left edge, a fixed end having a fixed end edge, and a rigid free end that defines an aperture of a size and shape to support and receive the weight of an object suspended from the roof;

a plurality of bending lines, wherein each bending line spans transversely of said body by and between the right edge and the left edge and is positioned between the free end and fixed end, wherein a first bending line is positioned nearest the free end and subsequent bending lines are positioned parallel of and spaced-apart from the first bending line opposite the free end, and wherein the last bending line, furthest from the free end, is positioned longitudinally of the body such that the longitudinal length of the body between the last bending line and the fixed end edge is greater than the longitudinal length between the last bending line and the free end, and wherein each bending line is bent to form an angle such that the anchor can conform to various roof types;

said body, between the fixed end edge and a portion of the body no greater than the last bending line, being permanently and fixedly connected to the sheathing, wherein the back of the body between the last bending line and the fixed end edge is in surface contact with the sheathing; and said roof cladding covers the anchor less the free end and sheathing in a way to allow said free end to protrude outwardly over the roof cladding;

wherein, in use, and object may be tied to the free end through the aperture in order to anchor the object to the roof.

2. The anchor system according to claim 1, wherein the body between the fixed end edge and a portion of the body no greater than the last bending line is permanently and fixedly connected to the sheathing by a plurality of lag bolts.

3. The roof safety anchor system according to claim 1, wherein the back of the body between the first and last bending lines makes surface contact with the sheathing.

4. The anchor system according to claim 3, wherein the body between the fixed end edge and a portion of the body no greater than the last bending line is permanently and fixedly connected to the sheathing by a plurality of lag bolts.

5. The anchor system according to claim 1, wherein the anchor and the defined aperture with the anchor's free end is of a size and shape to support and receive an object with weight to 5000 pounds.

6. The anchor system according to claim 1, wherein the anchor has two said bending lines bent to form a first angle situated between the free end and the second bending line, and a second angle situated between the fixed end and the first bending line.

7. The anchor system according to claim 6, wherein the first angle is in the range of 100 degrees to 120 degrees and the second angle is in the range of 145 degrees to 165 degrees.

8. The anchor according to claim 6, wherein the first angle is in the range of 100 to 120 degrees and the second angle is in the range of 95 to 110 degrees.

9. The anchor according to claim 1, wherein the anchor has three said bending lines to form a first angle situated between the free end and the second bending line, a second angle situated between the first and third bending lines, and a third angle situated between the fixed end and the second bending line.

10. The anchor according the claim 9, wherein the first angle is in the range of 100 to 120 degrees, the second angle is in the range of 70 to 90 degrees and the third angle is in the range of 95 to 110 degrees.

11. The anchor according to claim 1, further comprising at least one security tab projecting outwardly from the right edge of the body and at least one security tab projecting outwardly from the left edge of the body.

12. The anchor according to claim 11, wherein the at least one right tab is a different size than the at least one left tab.

13. The anchor according to claim 11, wherein each tab is laterally offset, longitudinally of the body in the transverse direction from the other at least one tab.

14. A method of securing a safely line to a building having a peaked roof with a first pitch and a second pitch, the roof having a layer of sheathing layered over a plurality of spaced apart structural beams, the method comprising:

providing a roof safety anchor having an elongated body with a right edge, a left edge, a free end defining an aperture, a fixed end, and two bending lines connecting the right edge to the left edge and are positioned between the free end and the fixed end;

bending the roof anchor to conform to the peak of the roof along its first and second bending lines forming a first angle between the free end and the second bending line and a second angle between the fixed end and the first bending line, wherein the second angle is formed to fit atop the peak of the roof and the first angle is formed to extend the free end outward, and wherein the longitudinal length of the body between the second bending line and the fixed end is greater than the longitudinal length between the second bending line and the free end;

mounting the bent anchor over the roof sheathing such that the second angle is mounted over the peak and the fixed end is fixedly connected to the roof sheathing on one pitch and the free end projects outwardly from the roof sheathing on the other pitch;

layering roof cladding over the roof sheathing such that the cladding is mounted over the fixed end of the anchor and underneath the free end of the anchor;

applying a ridge cap over the peak of the roof; and tying one end of a safety line to the free end through the aperture to secure the safety line to the roof.

15. The method according to claim 14, wherein the first angle is bent in the range of 100 to 120 degrees and the second angle is bent in the range of 145 to 165 degrees.

16. A method of securing a safety line to a building having a lower roof with a peak and an upper roof that is separated by a vertical wall, wherein the lower roof and wall each have sheathing layered over spaced apart structural beams, and the wall and lower roof join at the peak of the lower roof to form a roof angle, the method comprising:

providing a roof safety anchor having an elongated body with a right edge, a left edge, a free end defining an aperture, a fixed end, and two bending lines connecting the right edge to the left edge and are positioned between the free end and the fixed end;

bending the anchor to conform to the lower roof and the wall along its two bending lines forming a first angle between the free end and the second bending line, and a second angle between the fixed end and the first bending line, wherein the second angle conforms to the roof angle between the wall and lower roof and the first angle allows the free end to project outwardly, and wherein the longitudinal length of the body between the second bending line and the fixed end is greater than the longitudinal length between the second bending line and the free end;

mounting the bent anchor over the sheathing such that the second angle is mounted atop the roof angle, and the fixed end is fixedly connected to the sheathing on the wall, and the free end projects outwardly from the sheathing of the lower roof;

layering wall cladding over the wall sheathing such that the wall cladding covers the fixed end;

layering roof cladding over the lower roof sheathing underneath the free end; and tying one end of a safety line to the free end through the aperture to secure the safety line to the lower roof.

17. The method according to claim 16, wherein the first angle is bent in the range of 100 to 120 degrees and the second angle is bent in the range of 145 to 165 degrees.

18. A method of securing a safety line to a building having a one sided peaked roof with sheathing layered over spaced apart structural beams, the method comprising:

providing a roof safety anchor having an elongated body with a right edge, a left edge, a fixed end, a free end defining an aperture, and three bending lines, each bending line connecting the right edge to the left edge and is positioned between the free end and the fixed end;

bending the anchor along its three bending lines forming a first angle between the free end and the second bending line, a second angle between the first bending line and third bending line, and a third angle between the fixed end and the second bending line, wherein the second and third angles are bent to allow the body to angle back over the fixed end and the first angle is bent to allow the free end to project outwardly, and wherein the longitudinal length of the body between the third bending line and the fixed end is greater than the longitudinal length between the third bending line and the free end;

mounting the bent anchor over the sheathing such that the fixed end is fixedly connected to the sheathing and the second and third angles are positioned near the peak, and the free end projects outwardly from the roof;

layering roof cladding over the sheathing to cover the fixed end and underneath the free end and first and second angles; and tying one end of a safety line to the free end through the aperture to secure the safety line to the roof.

19. The method according to claim 18, wherein the first angle is in the range of 100 to 120 degrees, the second angle is in the range of 70 to 90 degrees and the third angle is in the range of 95 to 110 degrees.

20. A method of securing a safety line to a building having an at least one sided large peaked roof with sheathing layered over spaced apart structural beams, the method comprising:

providing a midspan roof safety anchor having an elongated body with a right edge, a left edge, a free end defining an aperture, a fixed end, and two bending lines connecting the right edge to the left edge and are positioned between the free end and the fixed end;

bending the anchor along the anchor's two bending lines forming a first angle between the free end the second bending line and a second angle between the fixed end and the first bending line, wherein the second and first angles allow the free end to project outwardly, and wherein the longitudinal length of the body between the second bending line and the fixed end is greater than the longitudinal length between the second bending line and the free end;

mounting the bent anchor over the sheathing such that the fixed end is fixedly connected to the sheathing in a generally central portion of one side of the roof and the free end projecting outwardly from the generally central portion of the roof;

layering roof cladding over the sheathing to cover the fixed end, leaving the free end exposed outside the roof sheathing; and tying one end of a safety line to the free end through the aperture to secure the safety line to the roof.

21. The method according to claim 20, wherein the first angle is bent in the range 100 to 120 degrees and the second angle is 95 to 100 degrees.

* * * * *